United States Patent [19]

Johnson

[11] Patent Number: 4,678,188

[45] Date of Patent: Jul. 7, 1987

[54] QUESTION AND ANSWER GAME STRUCTURE PARTICULARLY FOR USE IN A RESTAURANT OR THE LIKE

[76] Inventor: David W. Johnson, 5860 Hanley Rd., Jamestown, Ohio 45335

[21] Appl. No.: 776,514

[22] Filed: Sep. 16, 1985

[51] Int. Cl.[4] ..... A63F 9/18

[52] U.S. Cl. ..... 273/1 R; 434/348; 434/405

[58] Field of Search ..... 273/1 R, 1 C, 141 R, 273/141 A; 434/348, 349, 405

[56] References Cited

U.S. PATENT DOCUMENTS

| | | | |
|---|---|---|---|
| 2,098,003 | 11/1937 | Hassenfeld | 434/348 |
| 2,676,019 | 4/1954 | Steinberg | 273/141 R |
| 2,861,809 | 11/1958 | Fischl | 273/141 R |

*Primary Examiner*—Paul E. Shapiro

*Attorney, Agent, or Firm*—Jacox & Meckstroth

[57] ABSTRACT

A question and answer game structure which is particularly adapted for use in a restaurant or the like. The game structure comprises a body provided with one or more question-carrying surfaces which are adapted to carry indicia in the form of questions of interest and which are also adapted to carry advertising indicia. Movably positioned within the body adjacent each of the question-carrying surfaces is a card-like member which carries indicia in the form of answers to the questions which appear on the adjacent question-carrying surface. Preferably, each question-carrying surface has a window therein through which the answers are observable as the card-like member is positioned with respect to the window. The body also has a support surface which is provided with information portions identifying the question-carrying surfaces. The support surface rotatably supports a pointer which is movable with respect to the information portions to identify a question-carrying surface.

11 Claims, 3 Drawing Figures

QUESTION AND ANSWER GAME STRUCTURE PARTICULARLY FOR USE IN A RESTAURANT OR THE LIKE

BACKGROUND OF THE INVENTION

When two or more people enter a restaurant or the like as a group they are customarily seated at a table or in a booth for the purpose of eating food in that establishment. However, usually there is a waiting period before the people receive their food. Even if the people do not have to wait for their food, they are usually interested in an active discussion while they are eating.

It is an object of this invention to provide a question and answer game structure which is particularly created for use in a restaurant or the like.

It is another object of this invention to provide such a game structure which is adapted to include advertisement material.

It is another object of this invention to provide such a game structure which can be easily and readily held in a person's hand.

It is another object of this invention to provide such a game structure which creates interest during use thereof.

It is another object of this invention to provide such a game structure which can be produced in large quantities at a relatively small costs.

It is another object of this invention to provide such a game structure which is adapted to be given to customers of a restaurant or the like.

Other objects and advantages of this invention reside in the construction of parts, the combination thereof, the method of production and the mode of use, as will become more apparent from the following description.

SUMMARY OF THE INVENTION

A question and answer game structure of this invention comprises a body which can be easily and readily held in a person's hand. The body has a surface or surfaces which are adapted to carry questions which pertain to matters of interest. The surface or surfaces are also adapted to carry advertising material. The body also includes movable card-like members upon which the answers to the questions appear. Preferably, the card-like members are movable past a window so that only a limited portion of each card-like member appears through the window. Preferably, one surface of the body is a support surface and carries identifying indicia related to the surfaces which carry questions. The support surface rotatably supports a pointer member which is rotatable with respect to the identifying indicia to indicate or refer to a surface of the body which carries questions.

DETAILED DESCRIPTION OF THE INVENTION

Figure 1:
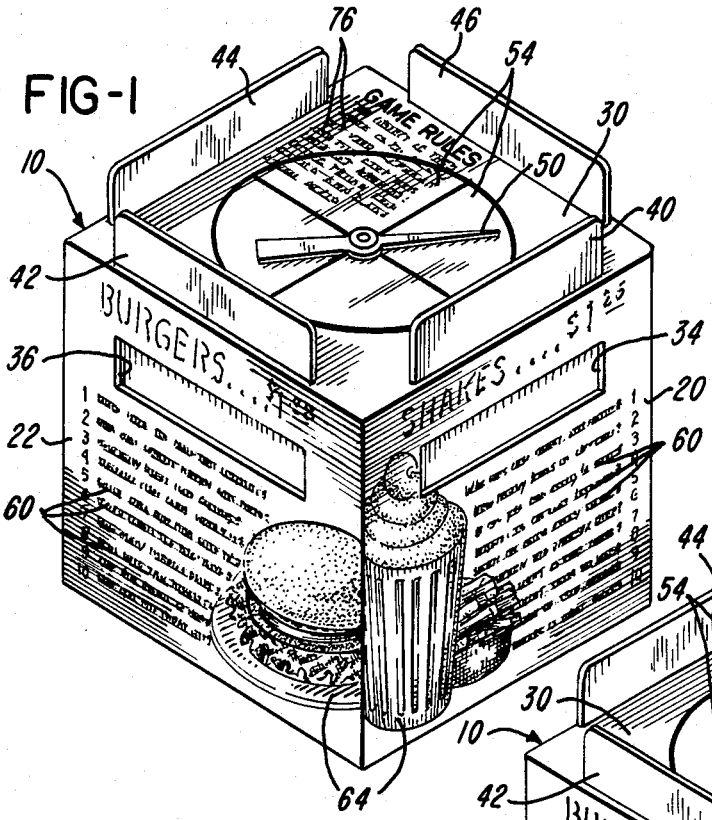
FIG. 1 is a perspective view showing a question and answer game structure of this invention.

The figures of the drawing show question and answer game structure of this invention which comprises a body 10. The body 10 is shown as being substantially a cube in shape. However, a body 10 may be any other suitable shape or configuration. Preferably, the body 10 is of a size and weight which can be easily and readily held in a person's hand. The body 10 may be solid or hollow in construction and may be made of any suitable material or materials. The body 10 is preferably constructed of card stock material which is cut to a proper shape and size and folded to form the body 10.

The body 10 has side surfaces 20, 22, 24, and 26. The body 10 has a top surface 30. The side surface 20 has a window 34 therein. The side surface 22 has a window 36 therein. The side surfaces 24 and 26 have similar windows therein.

Slidably positioned in the body 10 adjacent the side surface 20 is a card-like member 40. Slidably positioned in the body 10 adjacent the side surface 22 is a card-like member 42. Slidably positioned in the body 10 adjacent the side surface 24 is a card-like member 44. Slidably positioned in the body 10 adjacent the side surface 26 is a card-like member 46. A portion of the card-like member 40 is observable through the window 34 in the side surface 20. A portion of the card-like member 42 is observable through the window 36 in the side surface 22. Portions of the card-like members 44 and 46 are observable through the windows in the side surfaces 24 and 26, respectively.

The side surfaces 20, 22, 24, and 26 are adapted to carry indicia 60 consisting of questions of interest. The side surfaces 20, 22, 24, and 26 are also adapted to carry advertising material 64.

Rotatably mounted upon the top surface 30 of the body 10 is a pointer 50. On the top surface 30 below the pointer 50 are areas 54, each of which relates to one of the side surfaces 20, 22, 24, and 26.

Figure 2:
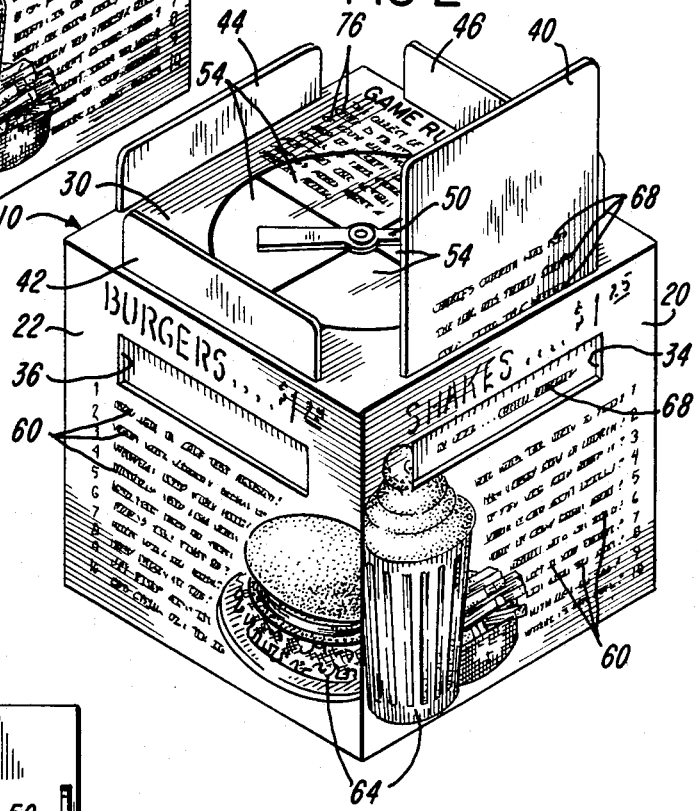
FIG. 2 is a perspective view, similar to FIG. 1, but illustrating an element of the structure in a position of use.
Figure 3:
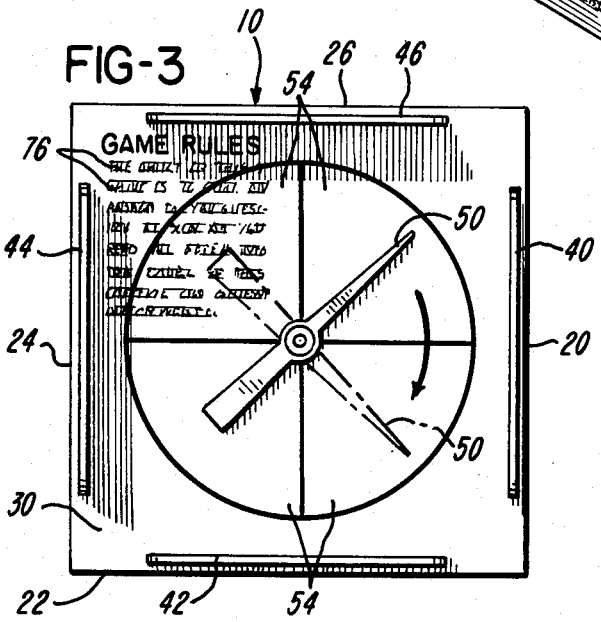
FIG. 3 is a top plan view of the question and answer game structure shown in FIGS. 1 and 2.

Indicia 68 consisting of answers to the questions carried upon the side surface 20 appear upon the card-like member 40. The answers are observable through the window 34 as the card-like member 40 is appropriately moved upwardly or downwardly with respect to the side surface 20 and the window 34, as illustrated in FIG. 2. The answers to the questions carried upon the side surface 22 appear upon the card-like member 42, and may be observed through the window 36 by appropriate upward and downward movement of the card-like member 42.

In playing the game of this structure, the pointer 50 is spun, and, when stopped, the pointer indicates which side surface of the body 10 is to be observed for reading of the questions carried thereby. The questions are then read and the proper card-like member 40, 42, 44, or 46 is then moved with respect to its respective window for reading the answers to the questions.

The top surface 30 also carries indicia 76 in the form of game rules which set out the procedures for playing the game carried by the body 10.

Thus, it is understood that a question and answer game structure of this invention is particluarly adapted for use by persons seated in a restaurant or the like to occupy the time during the meal and/or immediately before the meal. The structure of this invention also is adapted to carry advertising information which is observed by those using the game structure. The game structure of this invention may, of course, be used in environments other than in a restaurant or the like.

The game structure of this invention can be constructed and produced in large quantities at relatively low costs. Therefore, the game structure may be given to customers in a restaurant or the like and/or to other people.

Although the preferred embodiment of the question and answer game structure of this invention has been described, it will be understood that within the purview of this invention various changes may be made in the form, details, proportion and arrangement of parts, the combination thereof, and the manner of use, which generally stated consist in a question and answer game structure within the scope of the appended claims.

What is claimed is:

1. A question and answer game structure comprising a body which is substantially in the form of a cube and provided with a plurality of indicia-carrying side surfaces, each indicia-carrying side surface being provided with indicia in the form of questions, a plurality of answer-carrying member, there being one answer-carrying member movably positioned within the body and adjacent each of the indicia-carrying side surfaces, and selector means movably carried by the body for identifying one of the indicia-carrying side surfaces for consideration of the questions carried thereby.

2. The question and answer game structure of claim 1 in which the body has a support surface, the support surface being provided with a plurality of identifying portions; there being one identifying portion related to each of the indicia-carrying side surfaces, the selector means comprising a pointer rotatably mounted upon the support surface and movable with respect to the identifying portions to identify each of the indicia-carrying side surfaces.

3. The question and answer game structure of claim 1 in which the body is provided with a plurality of slots, there being a slot adjacent each of the side surfaces, the answer-carrying members comprising card-like members, each of the card-like members being movably positioned within one of the slots.

4. The question and answer game structure of claim 1 in which the body is provided with a plurality of slots, there being a slot adjacent each of the side surfaces, the answer-carrying members comprising card-like members, each of the card-like members being movably positioned within one of the slots, each of the side surfaces being provided with a window through which selective portions of the respective card-like member are observable as the card-like member is moved with respect to the window.

5. A question and answer game structure comprising a body provided with a surface which carries indicia in the form of questions, an answer carrying member at least partially positioned within the body and movably carried by the body adjacent the surface, the answer carrying member being provided with indicia in the form of answers to the questions, the body being provided with a plurality of side surfaces, a plurality of card-like members, there being one card-like member movably supported within the body adjacent each of the side surfaces, each of the side surfaces being provided with indicia in the form of questions, each of the card-like members being provided with indicia in the form of answers to the questions which appear on the side surface adjacent thereto.

6. A question and answer game structure comprising a body provided with a surface which carries indicia in the form of questions, an answer carrying member at least partially positioned within the body and movably carried by the body adjacent the surface, the answer carrying member being provided with indicia in the form of answers to the questions, the body being provided with a plurality of side surfaces, a plurality of card-like members, there being one card-like member movably supported within the body adjacent each of the side surfaces, each of the side surfaces being provided with indicia in the form of questions, each of the side surfaces being provided with a window, each of the card-like members being provided with indicia in the form of answers to the questions and being movable in juxtaposition with one of the windows and having portions observable through the window as the card-like member is moved with respect to the window.

7. A question and answer game structure comprising a body provided with a surface which carries indicia in the form of questions, an answer carrying member at least partially positioned within the body and movably carried by the body adjacent the surface, the answer carrying member being provided with indicia in the form of answers to the questions, the body being provided with a plurality of side surfaces, a plurality of card-like members, there being one card-like member movably supported within the body adjacent each of the side surfaces, each of the side surfaces being provided with indicia in the form of questions, each of the side surfaces being provided with a window, each of the card-like members being provided with indicia in the form of answers to the questions and being movable in juxtaposition with one of the windows and having portions observable through the window as the card-like member is moved with respect to the window, the body also having a support surface which carries indicia which refers to each of the side surfaces, a pointer mounted upon the support surface and being rotatably movable with respect to the support surface, the pointer pointing to indicia which refers to one of the side surfaces.

8. A question and answer game structure comprising a body provided with a surface which carries indicia in the form of questions, an answer carrying member at least partially positioned within the body and movably carried by the body adjacent the surface, the answer carrying member being provided with indicia in the form of questions, the body comprising a cube.

9. A question and answer game structure comprising a body provided with a surface which carries indicia in the form of questions, an answer carrying member at least partially positioned within the body and movably carried by the body adjacent the surface, the answer carrying member being provided with indicia in the form of answers to the questions, the body being provided with a plurality of side surfaces, the body being substantially in the form of a cube, a plurality of card-like members, there being one card-like member movably supported within the body adjacent each of the side surfaces, each of the side surfaces being provided with indicia in the form of questions, each card-like member carrying answers to the questions.

10. A game structure comprising a body which is provided with a plurality of side surfaces, at least one of the side surfaces being provided with indicia in the form of advertising material, at least one of the side surfaces being provided with indicia in the form of questions, at least one answer carrying member which carries indicia in the form of answers to the questions, each answer-carrying member having a portion movably positioned within the body, the body being provided with a support surface, selector means carried by the support surface to select and identify a side surface which is provided with indicia in the form of questions.

11. A game structure comprising a body which is provided with a plurality of side surfaces, at least one of the side surfaces being provided with indicia in the form of advertising material, at least one of the side surfaces being provided with indicia in the form of questions, at least one answer-carrying member which carries indicia in the form of answers to the questions, each answer-carrying member having a portion movably positioned within the body, the body being substantially in the form of a cube.

* * * * *